United States Patent [19]

Kenner

[11] Patent Number: 5,010,957

[45] Date of Patent: Apr. 30, 1991

[54] ENVIRONMENTAL MONITORING WELL HOUSING AND PROTECTION METHOD

[76] Inventor: Donald A. Kenner, Rt. 3, Box 220A, Sherwood, Oreg. 97140

[21] Appl. No.: 397,010

[22] Filed: Aug. 22, 1989

[51] Int. Cl.[5] ..... E21B 33/03

[52] U.S. Cl. ..... 166/379; 52/20; 137/371; 166/75.1; 404/25

[58] Field of Search ..... 166/378, 379, 75.1, 166/81, 96, 92–95, 97, 85; 52/20; 220/18; 141/86; 404/25, 26; 137/371, 363, 364

[56] References Cited

U.S. PATENT DOCUMENTS

| | | | |
|---|---|---|---|
| 653,909 | 7/1900 | Greger | 404/25 |
| 759,091 | 5/1904 | Delehanty . | |
| 1,509,643 | 9/1924 | Forsberg | 138/90 |
| 1,766,621 | 6/1930 | Fleming | 404/25 X |
| 3,063,500 | 11/1962 | Logan | 166/96 X |
| 3,220,433 | 10/1965 | Steil | 137/363 |
| 3,463,196 | 8/1969 | Richardson | 138/96 |
| 3,473,573 | 10/1969 | Baker et al. | 138/89 |
| 3,823,744 | 7/1974 | Logsdon | 138/96 |
| 3,856,050 | 12/1974 | Rooney | 138/96 |
| 3,942,681 | 3/1976 | Richardson | 220/324 |
| 4,014,367 | 3/1977 | Milo | 138/89 |
| 4,202,378 | 5/1980 | Bush et al. | 138/96 |
| 4,212,486 | 7/1980 | Logsdon | 285/4 |
| 4,335,740 | 6/1982 | Boley | 137/364 |
| 4,655,361 | 4/1987 | Clover et al. | 141/86 X |
| 4,669,536 | 6/1987 | Ames et al. | 166/68 |
| 4,696,330 | 9/1987 | Randman et al. | 141/86 |
| 4,706,718 | 11/1987 | Milo | 137/371 X |
| 4,723,866 | 2/1988 | McCanley | 404/25 |
| 4,747,453 | 5/1988 | Howard, Sr. | 166/96 X |

FOREIGN PATENT DOCUMENTS

| | | | |
|---|---|---|---|
| 1515278 | 6/1978 | United Kingdom | 52/20 |

*Primary Examiner*—Hoang C. Dang

*Attorney, Agent, or Firm*—William A. Birdwell

[57] ABSTRACT

An environmental monitoring well housing and protection method. A housing is disposed over the end of an environmental monitoring well pipe and set in concrete along with the well pipe itself so that the space between the housing and the well pipe is filled with concrete below the end of the well pipe. The housing has an interior ledge for receiving and supporting a cover. A flexible gasket is placed on the ledge, the cover is placed on the flexible gasket, and the two are fastened down by a pair of bolts that screw into threaded bores in the ledge. The cover thickness is substantially the same as the distance from the top of the housing down to the ledge, so that where the top of the housing is mounted flush with the ground the top of the cover is also flush with the ground. The cover includes recesses for the heads of each of the bolts, so that the resultant well head is entirely flush with the surface of the ground. The flexible gasket has an adhesive material on its underside for attachment to the ledge.

19 Claims, 3 Drawing Sheets

ENVIRONMENTAL MONITORING WELL HOUSING AND PROTECTION METHOD

BACKGROUND OF THE INVENTION

This invention relates to devices and methods for housing and protecting well heads, particularly for housing and protecting the heads of environmental monitoring wells while permitting convenient access thereto.

It has become a common practice to install monitoring wells in the ground in areas where the ground water is at risk of contamination. Such wells, known as environmental monitoring wells, are typically installed, for example, around the periphery of solid waste landfills or where there has been, or there is a potential for, a hazardous or toxic chemical spill. Water is periodically extracted from the wells and tested for the presence of contaminants.

Basically, environmental monitoring wells are just pipes installed vertically in the ground, extending to various depths and terminating at a well head near the surface of the ground. Typically, there is no substantial permanent equipment located at the well head; it is simply capped between usages. In some cases there may be a small monitoring device installed at the well head. There is ordinarily no attendant at the well head; it is only visited periodically to extract water for tests or, in some cases, to check a small monitoring device.

There is a risk that an environmental monitoring well can itself become a source of contaminants. This will happen if surface water containing contaminants, or an undiluted contaminant itself, is allowed to enter the well pipe. This can occur, for example, if there is uncontained surface water adjacent the well head at the time that it is uncapped for testing, or where the cap is not adequately sealed. It can also occur where part of the well head protrudes above the surface of the ground and is damaged by the movement of vehicles or heavy equipment, leaving the interior of the well pipe exposed in a manner that permits the introduction of contaminants. It is important to ensure that this does not occur.

In order to minimize the likelihood that environmental monitoring wells will contaminate the very water they are installed to test, it is desirable, if not required, to provide them with a fluid resistant housing in addition to the well cap itself; indeed it is desirable to provide a housing that is impervious to water and other fluids, i.e., fluid-tight. Known housings typically extend above the surface of the ground and provide a cover that is less than fluid-tight. For example, Ames et al. U.S. Pat. No. 4,669,536 discloses a protective housing disposed around the end of a monitoring well pipe, set in concrete and having a hinged cover on top. But, the housing extends above the surface of the ground where it can interfere with, and be damaged by, the movement of vehicles and equipment. There is no provision for making the hinged cap fluid-tight.

In addition, various types of caps are available for sealing pipes in general. Delahanty U.S. Pat. No. 759,081 shows a cap which, together with a gasket, is fastened to the end of a pipe by bolts. Baker et al. U.S. Pat. No. 3,473,573 and Forsburg U.S. Pat. No. 1,509,643 disclose well caps which are also fastened with bolts and include gaskets. Rooney U.S. Pat. No. 3,856,050 and Richardson U.S. Pat. No. 3,942,681 show flange protectors for placement over the ends of flanged pipes. However, none of these devices is, or could readily be, adapted to provide a fluid-tight cover for an environmental monitoring well that is in addition to the well pipe cap itself and is flush with the ground.

Therefore, it can be seen that there is a need for a new and improved environmental well housing that minimizes the risk of contamination of the ground water which the well is installed to monitor.

SUMMARY OF THE INVENTION

The present invention meets the aforementioned need for an effective environmental well housing, and overcomes the drawbacks of currently available devices, by providing a housing that is in addition to the well pipe cap itself, is flush to the ground, and is fluid-tight. An enclosure is disposed over the end of the well pipe and set in concrete along with the well pipe itself, so that the space between the enclosure and the well pipe is filled with concrete below the end of the well pipe, thereby sealing out contaminant fluids from below. The housing has an interior ledge for receiving and supporting a cover. A flexible gasket is placed on the ledge, the cover is placed on the flexible gasket, and the two are fastened down by a pair of bolts that screw into threaded bores in the ledge, thereby providing a fluid-tight seal for the top of the well. The cover thickness is substantially the same as the distance from the top of the enclosure down to the ledge, so that where the top of the enclosure is mounted flush with the ground the top of the cover is also flush with the ground. This arrangement produces a fluid-tight chamber for access to the upper end of the well pipe.

The cover includes recesses for the heads of each of the bolts, so that the resultant well head assembly is entirely flush with the ground surface. The rubber gasket has an adhesive material on its underside for attachment to the ledge, thereby ensuring that it will stay in place as the cover is attached and removed from time to time.

Therefore, it is a principal objective of the present invention to provide a novel and improved environmental monitoring well housing and protection method.

It is another objective of the present invention to provide an environmental monitoring well housing that is in addition to the well pipe cap itself.

It is a further objective of the present invention to provide an environmental monitoring well housing that is fluid-tight.

It is yet another objective of the present invention to provide an environmental well housing that is flush with the ground.

It is a feature of the present invention that it employs a housing disposed around and mounted in concrete along with the well pipe, the upper end of the housing being flush with the ground.

It is another feature of the present invention that it provides a cover that fits within the aforementioned housing so as to provide an upper well head surface substantially flush with the ground.

It is a further feature of the present invention that it includes a flexible gasket disposed between the aforementioned housing and the aforementioned cover, the gasket having an adhesive backing to keep it in place, to seal out fluids.

It is yet a further feature of the present invention that the aforementioned cover includes a pair of recesses for receiving heads of bolts for attaching the cover to the aforementioned housing, thereby ensuring that the bolt heads are disposed below the surface of the ground.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
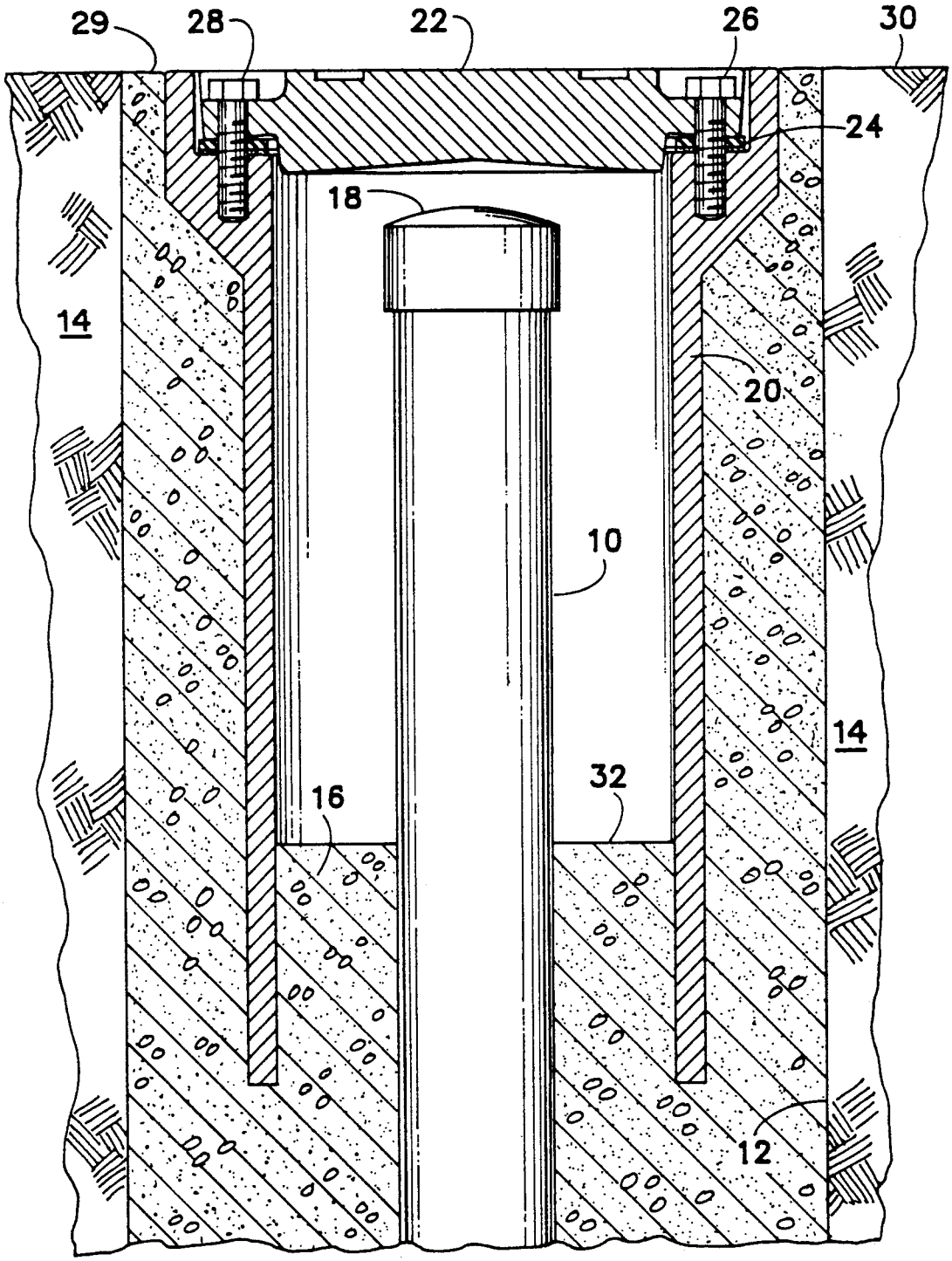
FIG. 1 is a cross section of a preferred embodiment of the environmental monitoring well housing of the present invention, installed in the ground together with an environmental monitoring well.

An overview of a preferred embodiment of the environmental monitoring well housing of the present invention installed in the ground at the head of a well is shown in FIG. 1. The well comprises a cylindrical pipe 10 disposed vertically, and extending down, in the ground for accessing ground water at a selected level. The well pipe is disposed at the center of a bore 12 in the ground 14, and surrounded by concrete 16 to a predetermined depth. Various other packing materials are typically disposed below the concrete. The top of the pipe is ordinarily closed by a cap 18, which is typically just a cup-shaped device that is pressure fit onto the pipe 10, though it may be attached by a variety of other means.

The environmental well housing comprises an enclosure 20 disposed around the well pipe 10 at the top thereof and set in the concrete 16 along with the well pipe so that the concrete fills the space between the inside of the enclosure and the outside of the well pipe. A cover 22 fits within the enclosure 20 at the top thereof so as to provide a substantially flat top surface. A flexible gasket 24 is disposed between the cover 22 and the enclosure to provide a fluid-tight assembly. The cover and gasket are attached firmly to the enclosure by a pair of bolts 26 and 28. The enclosure is mounted in the ground with a portion 29 of the concrete 16 surrounding the outside of the enclosure so that the upper surface of the entire assembly is substantially flush with the ground when the cover 22 is installed. Inside the enclosure the concrete 16 rises a few inches above the bottom of the enclosure to a level 32 several inches below the top of the well pipe 10.

Figure 2:
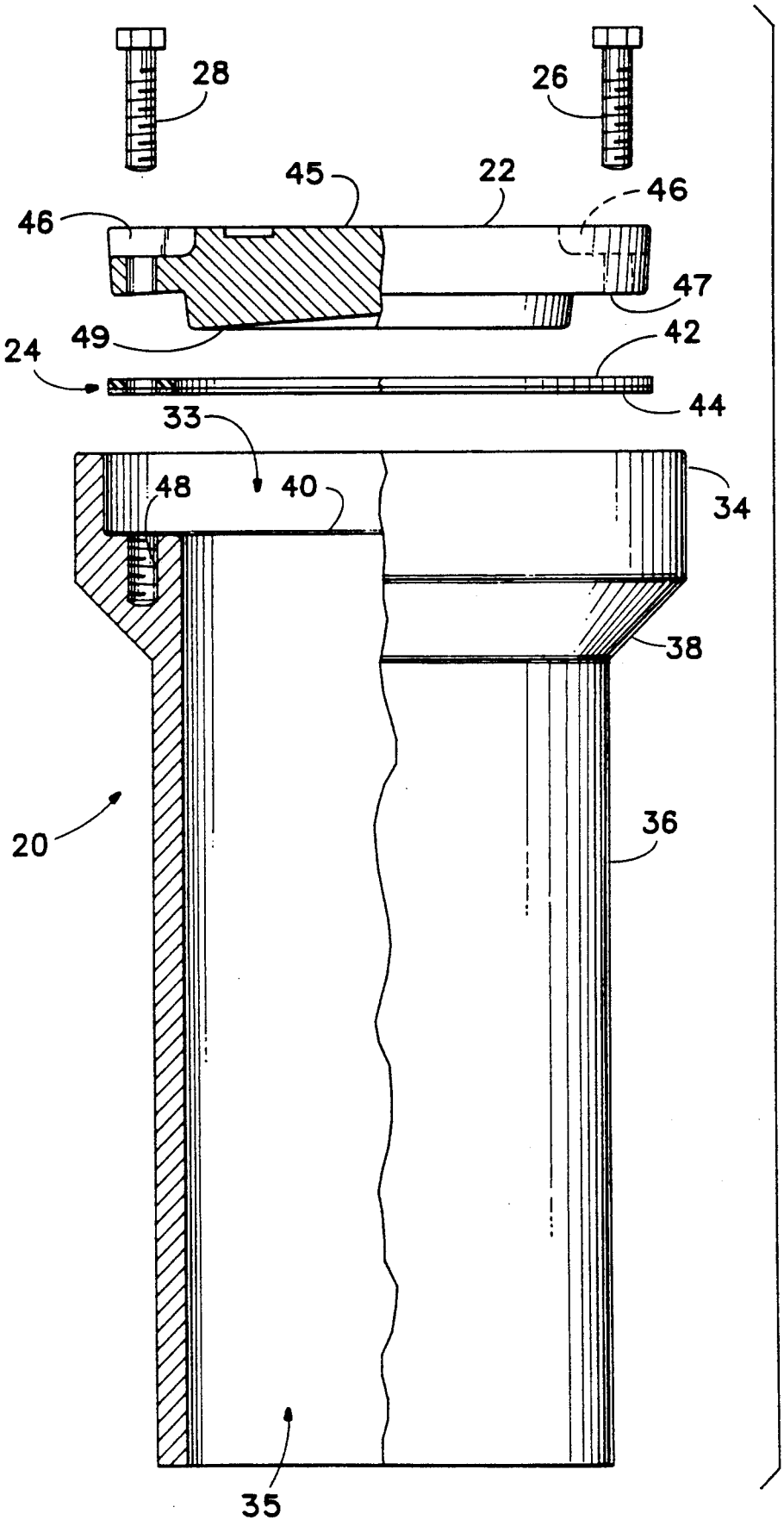
FIG. 2 is a cut away, partial cross section, exploded view of the aforementioned preferred embodiment of the well housing of the present invention.

Turning now to FIG. 2, the enclosure 20 of the well housing preferably, though not necessarily, comprises cylindrical sections. It has an upper section 34 of a first diameter, a lower section 36 of a second, smaller diameter, and a central section 38 that tapers from the upper section 34 to the lower section 36. The upper section provides an upper opening 33, and the lower section provides a lower opening 35. An inwardly-protruded ledge 40 is inside the enclosure, disposed above the central section 38, for supporting the flexible gasket 24 and the cover 22. Preferably, the enclosure 20 and cover 22 are made of cast and machined aluminum.

Figure 3:
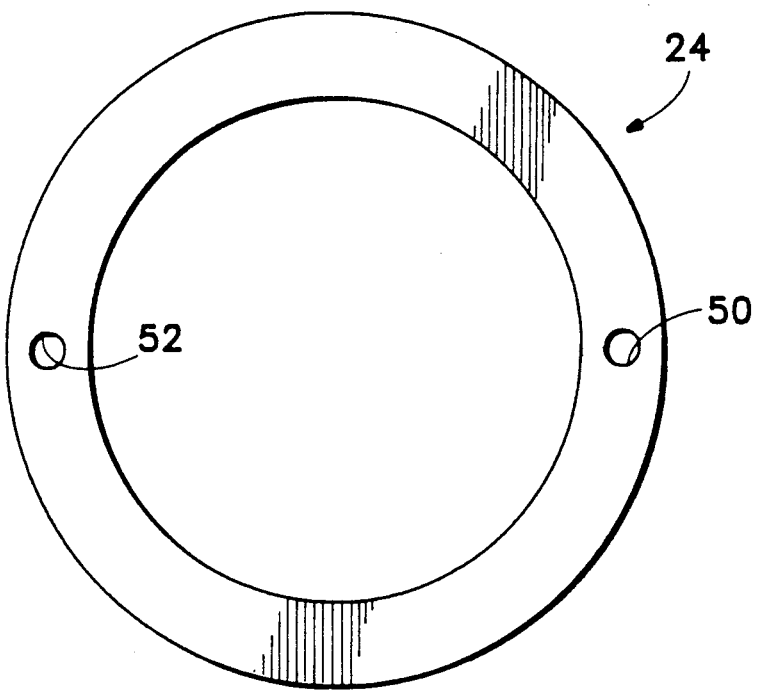
FIG. 3 is a top view of a flexible gasket portion of the aforementioned preferred embodiment of the well housing of the present invention.

The outer periphery of the gasket 24 and the cover 22 are shaped to fit just within the inner wall of the upper section 34 of the enclosure 20. Thus, in the case of an enclosure having cylindrical sections, the cover 22 is disc shaped and the gasket 24, like the upper surface of the ledge 40, is ring shaped. The ring shape of the gasket 24 can best be seen in FIG. 3.

The gasket 24 has a top portion 42 made of a flexible material, such as rubber, to seal the joint between the cover 22 and ledge 40 when compressed. It also has a bottom portion 44 comprising an adhesive backing for attaching the gasket 24 to the ledge 40 so as to retain the gasket in place when the cover is installed and removed from the enclosure from time to time.

The cover has an upper surface 45 and a lower surface 47, and a pair of recesses 46 in the upper surface for receiving the heads of bolts 26 and 28. The lower surface 47 may, but need not necessarily, include an offset 49. Thence, when the cover is installed the bolt heads are disposed below the upper surface of the cover so that the entire assembly is substantially flush with the surface of the ground. The ledge has a pair of threaded bores 48 for receiving the bolts 26 and 28 so that the cover may be firmly fastened to the enclosure. The gasket 24 has a pair of apertures 52 and 50 for allowing the bolts to pass therethrough. More than two bolts may be used, if desired, to ensure that the fluid-tight seal is not broken. In any event, the bolts should be disposed symmetrically around the periphery of the housing.

In use, the housing is installed in the well head along with the well pipe as shown in FIG. 1. The gasket 24 is placed in the enclosure 20 on the ledge 40, the cover 22 is placed in the enclosure on top of the gasket, and the bolts 26 and 28 are screwed into the bores 48 and tightened down. Thereafter, vehicles and machinery can be moved over the well head without obstruction or damage to the housing, which might otherwise break the fluid-tight seal. To access the well pipe for testing the ground water the bolts are removed and the cover is lifted away.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. In an environmental monitoring well having a well pipe disposed in a well bore with an upper end thereof extending toward the surface of the earth, a housing comprising:

(a) an enclosure having an upper opening and a lower opening, said enclosure being of unitary construction and being disposed in said well bore around said upper end of said well pipe, said upper opening of said enclosure being substantially flush with said surface of the earth;

(b) closure means, adapted to be disposed within said enclosure at said upper opening thereof, for closing said upper opening and preventing fluid from entering therethrough, said closure means having a substantially flat upper surface flush with said upper opening of said enclosure when installed therein; and (c) sealing means disposed in said well bore between the outer surface of said well pipe and the inner surface of said enclosure so as to partially fill the space therebetween, said sealing means comprising a material distinct from said well pipe and said enclosure, said material having a characteristic that allows it to flow into the space between the outer surface of said well pipe and the inner surface of said enclosure and assume a stable condition so as to seal off the space therebetween.

2. In an environmental monitoring well having a well pipe disposed in a well bore with an upper end thereof extending toward the surface of the earth, a housing comprising:

(a) an enclosure having an upper opening and a lower opening, said enclosure being disposed in said well bore around said upper end of said well pipe;

(b) closure means, adapted to be disposed within said enclosure at said upper opening thereof, for closing said upper opening and preventing fluid from entering therethrough, said closure means having a substantially flat upper surface flush with said upper opening of said enclosure when installed therein; and (c) sealing means disposed in said well bore between the outer surface of said well pipe and the inner surface of said enclosure so as to partially fill the space therebetween, said sealing means comprising a material distinct form said well pipe and said enclosure, said material having a characteristic that allows it to flow into the space between the outer surface of said well pipe and the inner surface of said enclosure and assume a stable condition so as to seal off the space therebetween, said sealing means being further disposed between the outer surface of said enclosure and the inner surface of said well bore, and beneath said enclosure, so as to seal off the space therebetween the outer surface of said enclosure and the inner surface of said well bore, and extending substantially continuously from inside said enclosure, beneath said enclosure, to outside said enclosure.

3. The housing of claim 2, wherein said enclosure includes an inwardly-protruding ledge between said upper opening and said lower opening, and said closure means comprises a cover having an upper surface, a lower surface, and a peripheral shape substantially identical to the shape of the interior of said enclosure between said ledge and said upper opening, said upper surface of said cover being substantially flush with said upper opening when said cover is installed within said enclosure.

4. The housing of claim 3, further comprising fastener means for attaching said cover to said enclosure such that said cover is disposed between said ledge and said upper opening.

5. The housing of claim 4, wherein said fastener means comprises a plurality of bolts having respective bolt heads, said enclosure includes a plurality of threaded bores in said ledge for receiving and engaging said bolts, and said cover includes a plurality of apertures therethrough for receiving said bolts and a plurality of corresponding recesses in said upper surface for receiving said bolt heads.

6. The housing of claim 3, wherein said closure means further comprises a flexible gasket having a shape substantially identical to the shape of said ledge and adapted to be placed between said cover and said ledge.

7. The housing of claim 6, further comprising a plurality of bolts having respective bolt heads, a plurality of corresponding threaded bores in said ledge for receiving and engaging said bolts, a plurality of corresponding apertures in said gasket for receiving said bolts, a plurality of corresponding apertures in said cover for receiving said bolts, and a plurality of corresponding recesses in the upper surface of said cover for receiving the heads of said bolts.

8. The housing of claim 6, wherein said gasket includes an adhesive backing for attachment to said ledge.

9. The housing of claim 2 wherein said enclosure comprises cylindrical portions.

10. The housing of claim 9, wherein said enclosure has an outside diameter at said upper opening that is greater than its outside diameter at said lower opening.

11. The housing of claim 2, wherein said sealing means comprises concrete.

12. The housing of claim 11, wherein there is space between the outer periphery of said enclosure at the upper opening thereof and the inner surface of said well bore, and a first section of said sealing means is disposed between said outer periphery of said enclosure and said inner surface of said well bore, said upper opening of said enclosure and said first section of said sealing means being substantially flush with the surface of the ground, and a second section of said sealing means between the outer surface of said well pipe and said enclosure is disposed below the upper end of said well pipe.

13. A method for housing and protecting an environmental monitoring well having a well pipe disposed in a well bore with an upper end extending toward the surface of the ground, comprising:

(a) placing an enclosure in said well bore around said upper end of said well pipe, said enclosure being of unitary construction and having an upper opening, a lower opening and an inwardly-protruding ledge between said upper opening and said lower opening;

(b) placing sealing means in said well bore between the outer surface of said well pipe and the inner surface of said enclosure, said sealing means being a composition distinct from said well pipe and said enclosure and having a characteristic that allows it to flow into the space between the outer surface of said well pipe and the inner surface of said enclosure and assume a stable condition so as to seal off the space therebetween;

(c) placing on said ledge a flexible gasket having a shape substantially identical to the shape of the surface of said ledge;

(d) placing on said gasket within said enclosure a cover having an upper surface and a peripheral shape substantially identical to the shape of the interior of said enclosure, and (e) attaching said cover to said enclosure so that said upper opening of said enclosure and said upper surface of said cover are substantially flush with the surface of the ground.

14. The method of claim 13, wherein said attach step is accomplished using fastener means disposed beneath said upper surface of said cover.

15. The method of claim 13, wherein said attaching step is accomplished using bolts disposed through said cover and said gasket and engaging said ledge of said enclosure.

16. The method of claim 13, wherein said enclosure comprises cylindrical sections.

17. The method of claim 13, wherein said enclosure has an outside diameter at said upper opening that is greater than its outside diameter at said lower opening.

18. The method of claim 13, wherein said gasket is adhesively attached to said ledge.

19. A method for housing and protecting an environmental monitoring well having a well pipe disposed in a well bore with an upper end extending toward the surface of the ground, comprising:

(a) placing an enclosure in said well bore around said upper end of said well pipe, said enclosure having an upper opening and a lower opening and an inwardly-protruding ledge between said upper opening and said lower opening;

(b) placing sealing means in said well bore between the outer surface of said well pipe and the inner surface of said enclosure, said sealing means being a composition distinct from said well pipe and said enclosure and having a characteristic that allows it to flow into the space between the outer surface of said well pipe and the inner surface of said enclosure and assume a stable condition so as to seal off the space therebetween;

(c) placing on said ledge a flexible gasket having a shape substantially identical to the shape of the surface of said ledge;

(d) placing on said gasket within said enclosure a cover having an upper surface and a peripheral shape substantially identical to the shape of the interior of said enclosure;

(e) attaching said cover to said enclosure so that said upper opening of said enclosure and said upper surface of said cover are substantially flush with the surface of the ground; and (f) placing said sealing means between the outer surface of said enclosure and the inner surface of said well bore, and beneath said enclosure, so as to seal off the space between the outer surface of said enclosure and the inner surface of said well bore, said sealing means extending substantially continuously from inside said enclosure, beneath said enclosure, to outside said enclosure.

* * * * *